US006403022B1

(12) United States Patent
Pavlicevic et al.

(10) Patent No.: US 6,403,022 B1
(45) Date of Patent: Jun. 11, 2002

(54) DEVICE FOR THE DIRECT REDUCTION OF IRON OXIDES

(75) Inventors: Milorad Pavlicevic, Udine; Alfredo Poloni, Fogliano di Redipuglia; Ljuban Milic, Udine, all of (IT)

(73) Assignee: Danieli & C. Officine Meccaniche, Buttrio (IT)

( * ) Notice: Subject to any disclaimer, the term of this patent is extended or adjusted under 35 U.S.C. 154(b) by 0 days.

(21) Appl. No.: 09/651,994

(22) Filed: Aug. 31, 2000

(30) Foreign Application Priority Data

Sep. 6, 1999 (IT) ..... UD99A0156

(51) Int. Cl.[7] ..... C21B 11/02
(52) U.S. Cl. ..... 266/197; 266/171
(58) Field of Search ..... 266/170, 171, 266/172, 197; 75/439

(56) References Cited

U.S. PATENT DOCUMENTS 4,374,585 A 2/1983 Papst et al.
4,725,309 A 2/1988 MacKay et al.
5,387,274 A * 2/1995 Dam et al. ..... 75/439
5,618,032 A * 4/1997 Meissner et al. ..... 75/439
6,146,442 A * 11/2000 Sanford ..... 266/197

FOREIGN PATENT DOCUMENTS

DE 19838368 8/1999

* cited by examiner

*Primary Examiner*—Scott Kastler
(74) *Attorney, Agent, or Firm*—Stevens, Davis, Miller & Mosher, LLP

(57) ABSTRACT

Device for the direct reduction of iron oxides of the type with a gravitational load, comprising a reactor defining, in its upper part, at least a zone inside which the reduction reaction occurs, means (14, 15) to introduce the load through a mouth (12) of the reactor, means (18, 17, 19) to introduce a current of gas into at least one section of the reactor in correspondence with the reduction zone, outlet means (13) of the reduced material from the bottom of the reactor, and means (20) to discharge the exhaust fumes, said reactor (10) including at least a first upper zone (10*a*) of heating, pre-reduction and final reduction, with a taper diverging downwards, and a second lower zone (10*b*) of carburization and cooling, with a taper converging downwards.

19 Claims, 4 Drawing Sheets

DEVICE FOR THE DIRECT REDUCTION OF IRON OXIDES

FIELD OF THE INVENTION

This invention concerns a device for the production of metal iron by means of the direct reduction of mineral iron, wherein the iron is present in the form of oxides, by means of a direct reduction of said oxides The device according to the invention comprises a reactor which is at least partly shaped like a truncated cone and wherein the various processes take place which achieve the direct reduction of the iron oxides.

The reduced iron can emerge from the reactor either hot or cold and subsequently can be sent to a melting furnace to produce liquid steel, or can be converted into hot brick iron (HBI), or again it can be transported into a cooling and storage zone In correspondence with one or more different longitudinal zones, the reactor is provided with a conduit equipped with nozzles through which reducing gas is injected.

This invention is characterized by the fact that the reduction reactor has a multiple taper conformation, diverging by at least an angle in its upper part and converging by at least an angle in its lower part.

BACKGROUND OF THE INVENTION

In the field of steel production, the use of reduced iron (DRI) as a loading material for melting or conversion processes is more and more common.

The process to obtain reduced iron provides to make the mineral iron react with a current of reducing gas in an appropriate device comprising a reaction container, called the reactor, defining in its height at least a zone wherein the reduction process occurs.

The devices used are generally of the gravitational type, also called shaft types, and comprise a central part, with a substantially cylindrical or truncated cone shape, a cylindrical upper zone for loading, a lower zone for discharge, means to inject reducing gas into one or more zones of the reactor and means to create an intake of the gases, at least in the upper zone.

In order to optimize the performance of the chemical processes to reduce the iron oxides, it is necessary to create conditions of uniform distribution, inside the reduction device, both of the load of mineral introduced and also of the reducing gas.

In conventional reactors, particularly large size ones, the flow of reducing gas introduced laterally prevalently affects the peripheral zone: this gives a reduced yield of the reduction reactions in correspondence with the central zone.

Moreover, in traditional reactors blockages of material are often created in the upper part, particularly with certain types of material, and/or the material sticks on the walls when the material to be reduced comes into a partly plastic state Furthermore, if the injection of the current of gas occurs in a reduction zone of the reactor where the diameter is too large, this entails poor efficiency and therefore low yield of the reduction process.

Irregularities in the flow of material and gas inside the reactor cause a poor yield in the reduction process, and negatively affect the productivity of the device.

The lower part of the reactor, converging downwards, conventionally has a constant taper.

With this conformation, the volume of material passing through is very limited and, to keep productivity high, the time the solid material remains inside the reactor is also limited.

Therefore, the carbon (C) is not given the necessary time to spread efficaciously in the molecular structure of the metal, and therefore it is not possible to obtain the desired compounds of Fe and C, such as for example $Fe_3C$. DE-C-198 38 368 discloses a reactor for the direct reduction of iron material which comprises, in its upper part, a tubular inner prevacuum chamber able to uniformly spread the charge of material introduced into the reactor from the above.

This chamber has also the function of dividing, in the upper part of the reactor, the central inner zone, through which the charge of iron material is fed into the reactor, from the peripherical annular zone which is empty and through which the gasses exiting from the inner of the reactor are made to transit.

This chamber has no function of pre-heating or reducing of the iron oxides fed into the reactor The present Applicant has devised and embodied this invention to overcome all these shortcomings, to improve the efficiency of the process and the quality of the product

SUMMARY OF THE INVENTION

The reduction device according to the invention is of the gravitational or shaft type, wherein both the material and the gas are advantageously fed continuously, so as to create a vertical and gravitational flow of the material and to achieve the direct reduction of the mineral.

The reduction device according to the invention is equipped with means to feed the mineral iron and means to discharge the reduced metal iron.

The device is also equipped with conduits to inject the reducing gas in correspondence with one or more zones distributed on the height of the reactor.

One purpose of the invention is to achieve a reduction device in which there is a stable and uniform distribution both of the load of metal and also of the reducing gas throughout the volume full of mineral iron, so as to obtain high productivity, a better quality of the reduced iron and a greater quantity of carbon, possibly as $Fe_3C$.

Another purpose of the invention is to achieve a device wherein the load material is prevented from amassing and blocking in correspondence with the upper part of the reactor, and which avoids the risks of the superheated material sticking against the walls of the reactor.

A further purpose of the invention is to encourage and facilitate the descent of the reduced material, in the lower part of the reactor, towards the outlet from the reactor, at the same time improving the efficiency of the injection of the gas in said zone and increasing the volume available for reaction.

According to the invention, the reduction device comprises a reactor defined by a first upper zone, with a taper diverging downwards, and a second lower zone, with a taper converging downwards.

According to a preferential embodiment of the invention, the second lower zone is defined by at least two segments equipped with respective angles of convergence which are different from each other.

The first upper zone defines a heating, pre-reduction and final reduction zone where, thanks to the introduction of currents of reducing gas into at least one circumferential zone, the following transformation reactions are achieved: $Fe_2O_3$—>$Fe_{3O4}$, $Fe_3O_4$—>FeO and FeO—>Fe.

The second lower zone comprises the transition zone and the zone where the metallized material is carburized and cooled.

According to a variant, between the divergent upper zone and the convergent lower zone there is a substantially cylindrical separation segment wherein the reduction reactions are completed.

The divergent conformation of the first upper zone encourages a better distribution of the load inside the reactor and a better distribution of the gas over the whole inner volume.

The better distribution of the load and gas causes a higher heat yield of the chemical reactions, which can take place faster and with a consequent increase in productivity. in the higher part of the reactor, the downwardly divergent form encourages the downward flow of the material, preventing it from sticking to the walls.

During the reaction of the $Fe_2O_3$ to $Fe_3O_4$, the mineral iron increases in volume by a value which can vary from 15 to 30%, according to the conditions of the process and the type of material loaded.

This increase in volume causes a corresponding increase in the pressure on the pellets of material introduced, thus increasing the risk of their sticking to the walls.

The divergent conformation of the reactor in its upper part increases the volume available as the material descends, preventing blockages and allowing the volume to increase freely.

In the peripheral zones, moreover, there is no longer any pressure exerted by the column of material, which reduces the chances of sticking.

According to the invention, the angle of aperture of the first divergent upper part of the reactor with respect to the vertical is between 1 and 5 degrees, advantageously around about 3 degrees.

The first upper part has an extension in height, according to the invention, of between about ¼and about ½of the overall height of the reactor.

According to another embodiment, the first upper part has a conformation defined by two or more consecutive segments having a different angle of divergence to the vertical The convergent conformation of the second lower part causes an increase in the efficiency of injection of the gas, due to the reduction in the diameter of the section of the reactor where the gas is introduced.

In the lower part of the reactor, the downwardly converging form encourages a decrease in the speed of the gas as the gas gradually rises from the bottom upwards.

In this way, the time available for the gas to complete the reactions increases, with regard to carburization, so that carbon is obtained in the form of $Fe_3C$; there is also more time for the gas to exchange heat with the material, thus allowing the gas to cool.

According to a preferential embodiment, the taper of the lower part of the reactor has two or more segments with a progressively larger taper.

This embodiment allows to adapt the form of the terminal segment of the reactor as the temperature of the material varies.

In fact, as it gradually descends inside the reactor, the material cools and thus its tendency to stick to the walls decreases.

Thus the volume available in the lower zone of the reactor is increased and the conditions for carburization and cooling are optimized.

Moreover, the reduced material is unloaded more quickly and efficiently towards the outlet zone and the discharge means.

According to the invention, the angles of convergence of the second lower zone are between 5 and 20 degrees, advantageously between 8 and 15 degrees, to the vertical.

BRIEF DESCRIPTION OF THE DRAWINGS

These and other characteristics of the invention will become clear from the following description of some preferred forms of embodiment, given as a non-restrictive example, with reference to the attached drawings wherein.

DETAILED DESCRIPTION OF PREFERRED EMBODIMENTS

Figure 1:
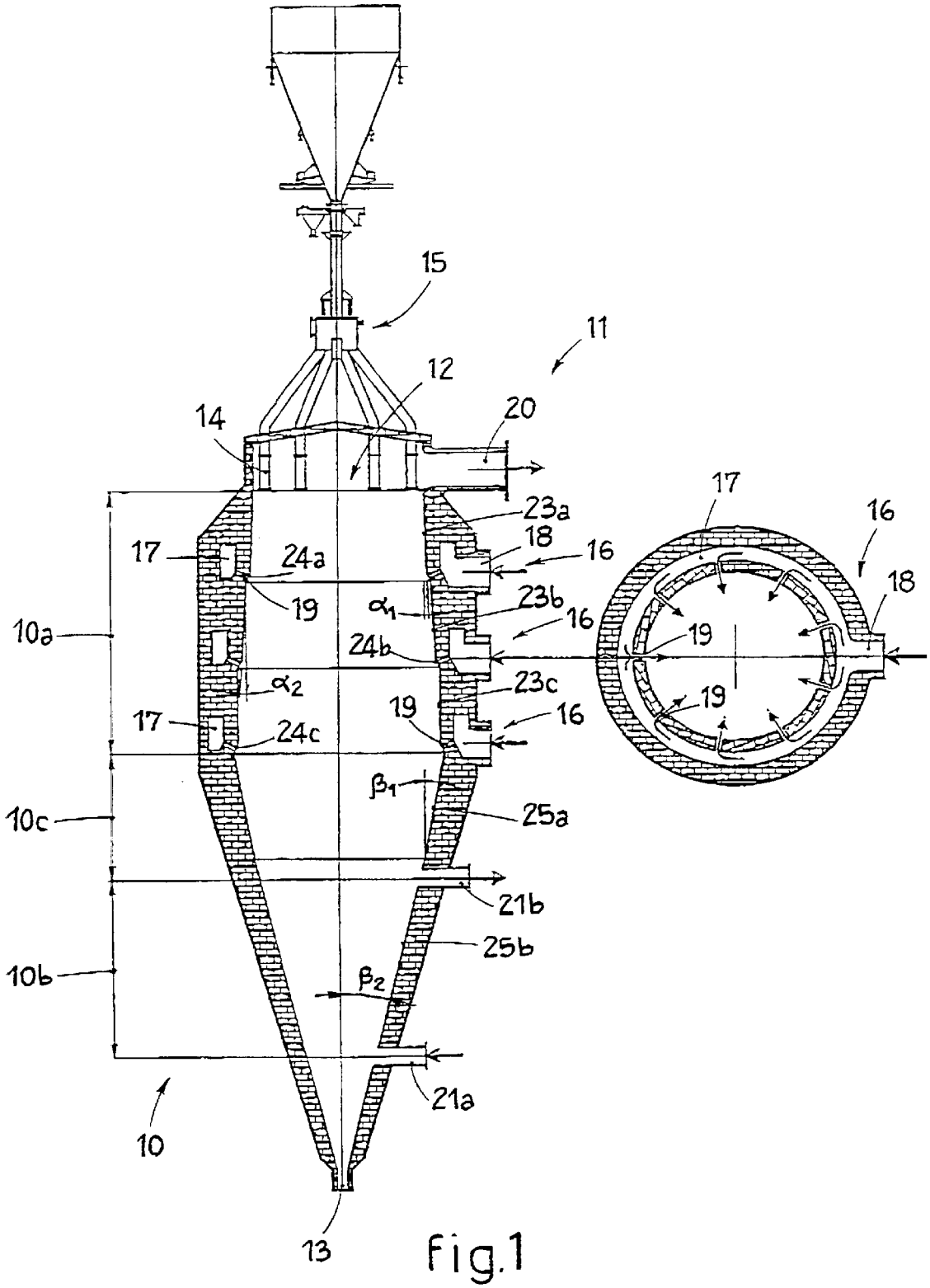
FIG. 1 shows a schematic longitudinal section of a first embodiment of the device for the direct reduction of iron oxides according to the invention.

With reference to FIG. 1, a device 11 for the direct reduction of iron oxides according to the invention comprises a reactor 10 equipped with an upper mouth 12 for feeding material from above, through which the mineral (iron oxides) is suitable to be introduced, and a lower aperture 13 through which the iron emerges.

The inner walls of the reactor 10 are lined in a conventional manner, totally or partly, at least in the upper part, with refractory material.

The reactor 10 is provided in its upper part with a circumferential aperture 20 through which the exhaust gas exits.

The upper mouth 12 of the reactor 10 cooperates with a device 15 to introduce the mineral iron consisting of a plurality of introduction tubes 14 suitable to distribute the loaded metal material uniformly over the entire section of the reactor 10.

The iron-based metal oxides are introduced into the reactor 10 in the form of pellets or coarse mineral of the appropriate size; the iron contained therein is between 63% and 68% in weight.

At the end of the method according to the invention the iron contained in the reduced material emerging from the reactor 10 is normally between 80% and 90% in weight.

According to the main characteristic of the invention, the reactor 10 is divided into at least a first upper zone 10*a*, or reduction zone, shaped like a truncated cone diverging downwards, and a second lower zone 10*b*, or carburization and cooling zone, shaped like a truncated cone converging downwards and towards the outlet mouth 13.

The first upper zone 10*a*, which occupies a height of between about ¼and about ½of the overall height of the reactor 10, cooperates with at least a zone 16 for the circumferential introduction of a current of reducing gas.

The introduction zone 16 may be of the type shown schematically with the section in FIG. 1, and may comprise a feed conduit 18 associated with a circumferential collector 17, which cooperates with a plurality of apertures or nozzles 19 suitable to convey the current of gas inside the volume of the reactor 10.

The reducing gas and the plant upstream of the conduit 18 may be of any conventional type, and therefore are not described here in further detail.

In the first upper zone 10*a*, the reactions to reduce the metal material occur, with progressive transformations of $Fe_2O_3$ into $Fe_3O_4$, of $Fe_3O_4$ into FeO and the of FeO into Fe.

Figure 3A:
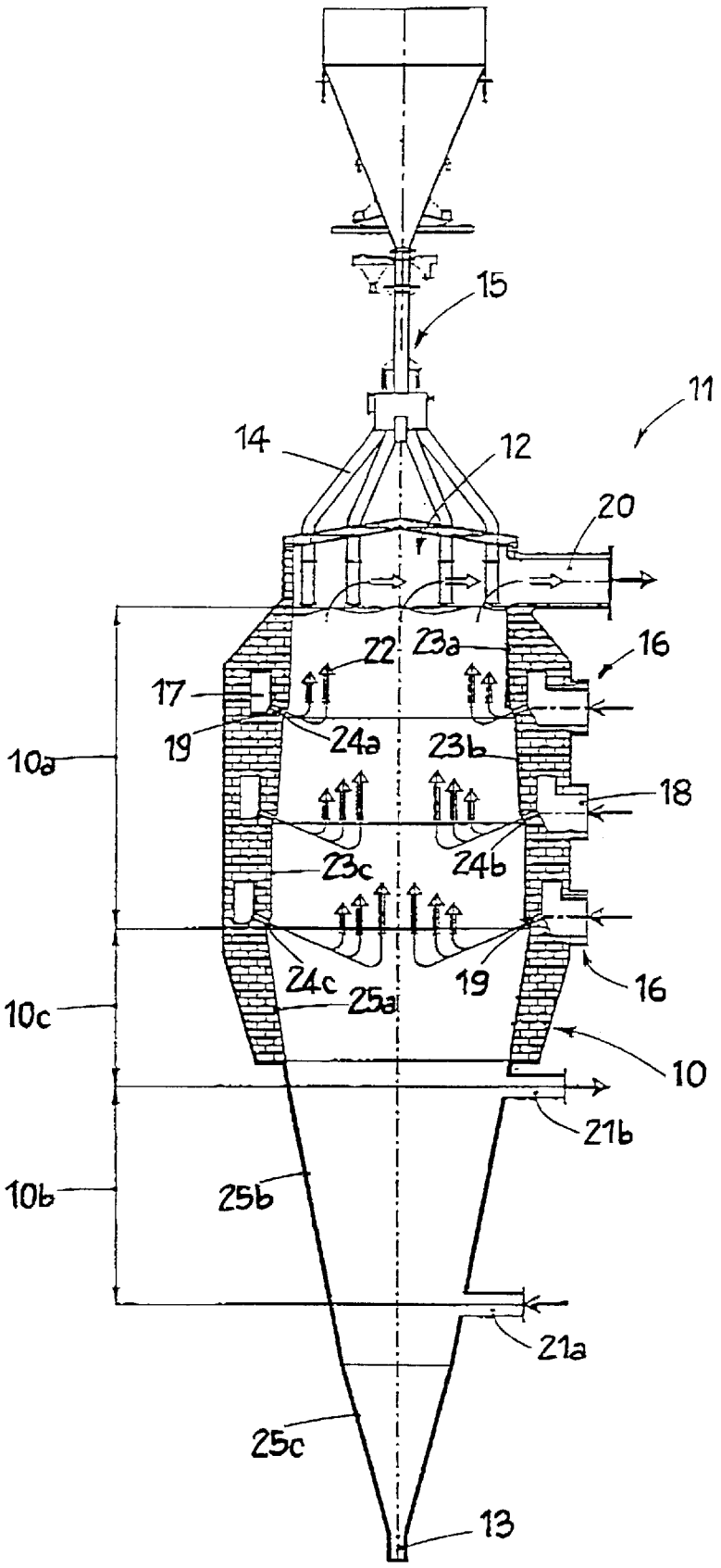
FIG. 3*a* shows a third embodiment of the device according to the invention.

The gas introduced into the various sections of the reactor 10 rises upwards, in the direction of the arrows 22 shown in FIG. 3*a*, and meets the iron minerals in the upper zone 10*a*, causing the reactions of progressive reduction of the iron oxides.

The upper part 10*a* of the reactor 10 is defined, in the embodiments shown here, by three consecutive segments, respectively 23*a*, 23*b* and 23*c*, separated by respective inclined transition segments 24*a*, 24*b* and 24*c*, arranged in correspondence with the gas introduction sections inside the reactor 10.

The co-operation between the nozzles 19 and the inclined segments 24*a*, 24*b* and 24*c* makes the distribution of the gas inside the reactor 10 more efficacious and more uniform.

The two upper segments 23*a*and 23*b* are at least slightly divergent towards the outside, defining respective angles $\alpha 1$ and $\alpha 2$ to the vertical.

The third segment 23*c* may be cylindrical with parallel walls, slightly diverging or even slightly converging downwards.

Figure 2:
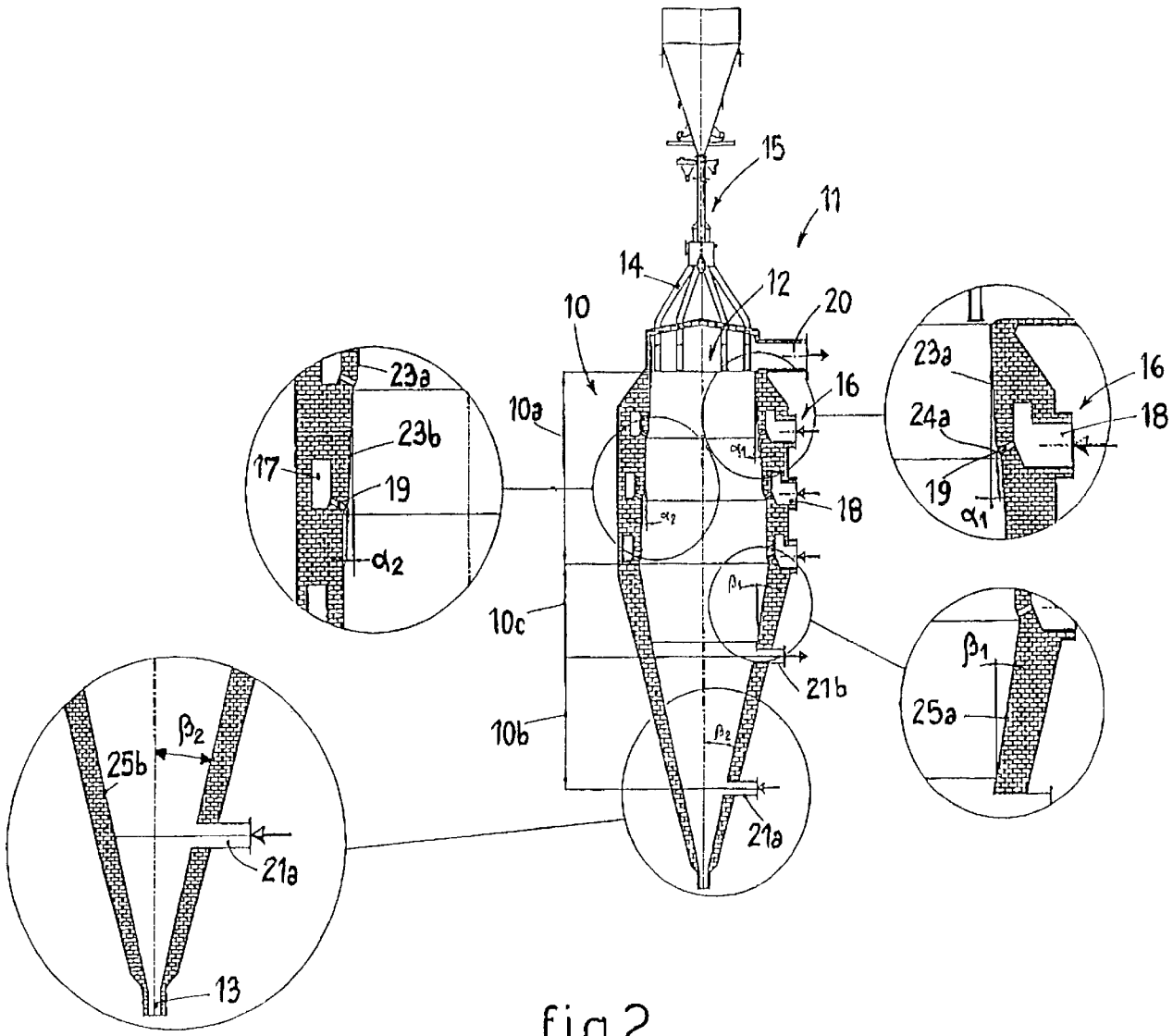
FIG. 2 shows another embodiment of the device according to the invention, highlighting some details of the conformation of the reactor.

In a first embodiment, the angles $\alpha 1$ and $\alpha 2$ are equal (FIG. 2).

According to a variant, the angles $\alpha 1$ and $\alpha 2$ are different, with $\alpha 1 > \alpha 2$ (FIG. 1)

The divergent upper zone causes a greater volume of reaction and therefore greater reaction speeds and an increase in yield and productivity.

Moreover, the risk of the plasticized material sticking to the walls is reduced, because the material flows downwards better and there is less pressure on the pellets towards the peripheral zone of the reactor 10.

According to the invention, the angles $\alpha 1$ and $\alpha 2$ have values of between 1° and 5°.

The reduced material leaving the upper zone 10*a* arrives in the lower zone 10*b*, where the material is carburized/cooled and then sent towards the outlet 13 of the reactor 10.

According to the embodiments of the invention shown here, the lower zone 10*b* of the reactor 10 is convergent downwards and in this case it is characterized by at least two segments with different convergence.

To be more exact, as shown in FIGS. 1 and 2, it comprises a first segment 25*a*, defined by a first angle $\beta 1$ with respect to the vertical, and a second segment 25*b* defined by a second angle $\beta 2$ with respect to the vertical.

The first segment 25*a* substantially acts as a transit zone 10*c* for the reduced material which is travelling towards the outlet mouth 13.

An the second segment 25*b*, characterized by a more accentuated downward convergence than that of the first segment ($\beta 1 < \beta 2$), the reduced material is carburized and cooled.

In the second segment 25*b*, a cooling fluid is made to circulate, fed by means of an inlet conduit 21*a* and discharged by means of an outlet conduit 21*b*. The angles $\beta 1$ and $\beta 2$ according to the invention are between about 5 and about 20 degrees, preferentially between about 8 and 15 degrees; the angle $\beta 2$ is advantageously around 12 degrees.

The convergent conformation of the lower zone 10*b* of the reactor 10 gives the substantial advantage of an increase in the efficiency of the injection of the gas, thanks to the progressive reduction in diameter.

Moreover, the gas progressively reduces its speed as it gradually rises towards the upper part of the reactor 10; this brings a longer time to complete the reduction reactions and hence an improved efficiency.

Figure 3B:
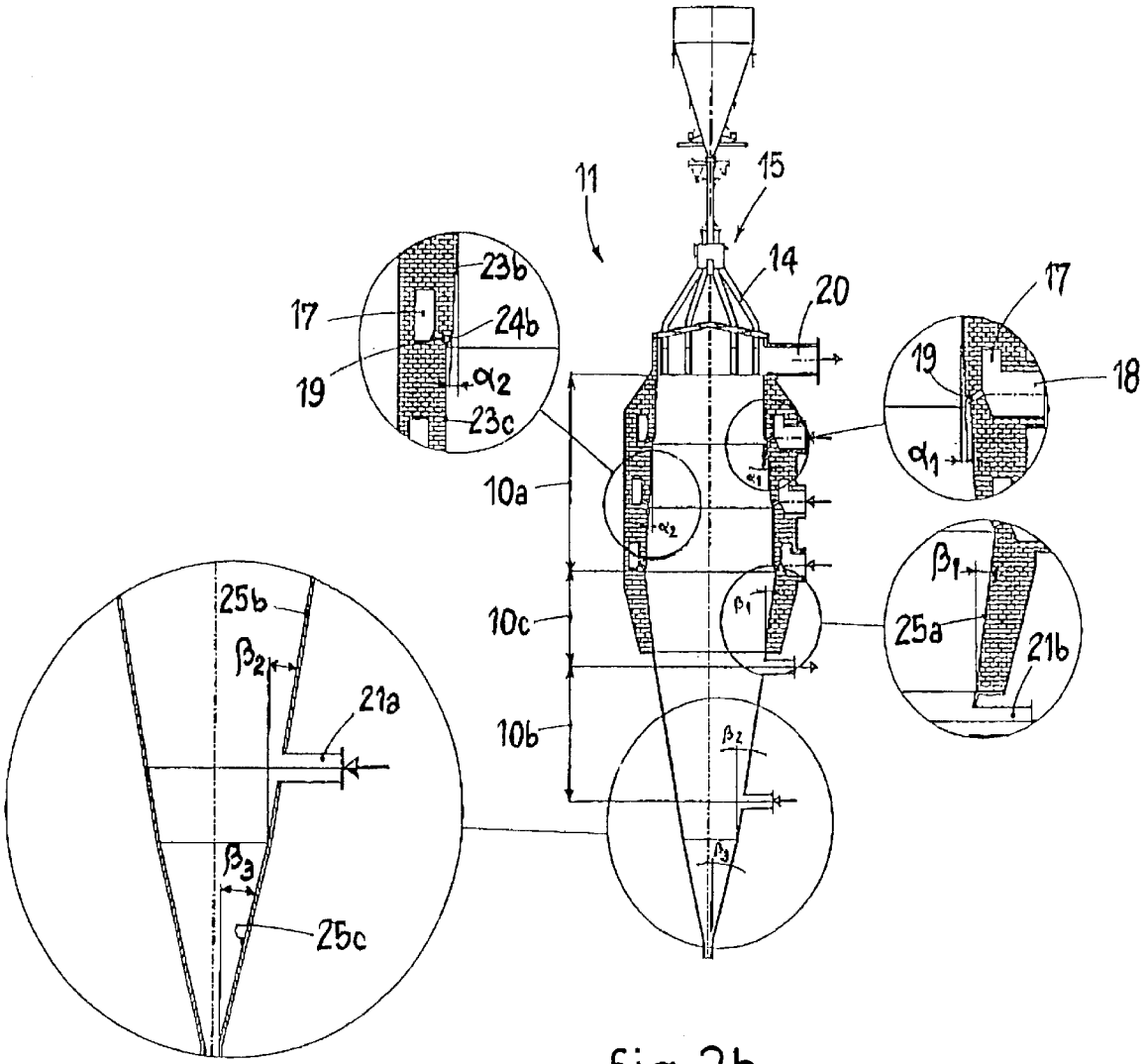
FIG. 3*b* shows the device as in FIG. 3*a*, highlighting some details of the conformation of the reactor.

According to the further embodiment shown in FIGS. 3*a* and 3*b*, the lower zone of the reactor 10 comprises a third segment 25*c* with a downward converging conformation and an angle $\beta 3$ greater than $\beta 3$.

The third segment 25*c* communicates with the outlet mouth 13 and its more accentuated taper allows to direct the 10 reduced metal material better towards the outlet mouth 13.

Moreover, the progressive greater taper of the reactor 10, as the material gradually proceeds towards the outlet mouth 13, adapts to the progressive cooling of the material, which thus has a reduced tendency to stick to the walls.

With this double or triple convergence conformation, it is possible to obtain a greater volume in the cooling and carburization zone, and optimize the efficiency and performance of the reactions.

It is obvious that modifications and addition can be made to this invention, but these shall remain within the field and scope thereof.

For example both the upper zone and the lower zone may be characterized by three, four or more consecutive segments, characterized by different respective angles of convergence or divergence, in the sense of a progressively increasing divergence in the upper part of the reactor 10 and a progressively increasing convergence in the lower part.

There may be four or more gas introduction zones, just as there may be present two or more apertures for the outlet of the exhaust gas.

The reactor 10 can be fed with means to introduce the material of a different type, for example, equipped with movable means to uniformly distribute and/or stir the material.

The cooling circuit included in the lower part may comprise several inlets and several outlets, for example located at different heights, and may have different cooling conditions according to the section of the reactor affected by the cooling.

It is therefore obvious that although the description of this invention refers to specific examples, a person of skill in the field will be able to achieve various other equivalent embodiments of direct reduction reactors, all of which shall remain within the field and scope of this invention.

What is claimed is:

1. A device for the direct reduction of iron oxides with a gravitational load, comprising a reactor defining, in its upper part, at least a reduction zone inside which the reduction occurs, means to introduce the load through a mouth of the reactor, means to introduce a current of gas into at least one section of the reactor in correspondence with the reduction zone, means for discharging the reduced material from the bottom of the reactor, and means to discharge the exhaust fumes, wherein said reactor includes a first upper zone of heating, pre-reduction and final reduction, the first upper zone having a taper beginning adjacent the mouth and diverging downwards, and a second lower zone of carburization and cooling, with a taper converging downwards.

2. The device as in claim 1, wherein the angle of aperture $\alpha$ of said first upper zone with respect vertical is between 1 and 5 degrees.

3. The device as in claim 2, wherein the angle of aperture $\alpha$ of said first upper zone with respect to vertical is about 3 degrees.

4. The device as in claim 1, wherein the extension in height of said first upper zone is between ¼ and ½ of the height of the reactor.

5. The device as in claim 1, wherein said first upper part has a conformation defined by at least two consecutive segments which have a different respective angle of convergence with respect to the vertical.

6. The device as in claim 5, wherein said first upper part has a conformation defined by three consecutive upper segments separated by respective inclined segments, at least two said upper segments diverging downwards with respective angles of divergence $\alpha 1$, $\alpha 2$.

7. The device as in claim 6, wherein the third segment is cylindrical with parallel walls.

8. The device as in claim 6, wherein the third segment is converging downwards.

9. The device as in claim 6, wherein said inclined segments are arranged in correspondence with the sections wherein the gas is introduced into the reactor.

10. The device as in claim 1, wherein the lower zone comprises at least a first segment converging downwards with an angle and a second segment convergent with an angle $\beta 2$ and consecutive to said first segment.

11. The device as in claim 10, wherein $\beta 1 > \beta 2$.

12. The device as in claim 10, wherein the angles $\beta 1$, $\beta 2$ are between 5 and 20 degrees.

13. The device as in claim 10, wherein the angle $\beta 2$ is about 12 degrees.

14. The device as in claim 10, wherein at least said second segment cooperates with a cooling circuit comprising at least an inlet conduit and an outlet conduit for the cooling fluid.

15. The device as in claim 10, wherein said lower zone also comprises at least a third segment facing towards the outlet and converging downwards with an angle $\beta 3$, where $\beta 3 > \beta 2 > \beta 1$.

16. The device as in claim 1, wherein the means to introduce the current of reducing gas comprise at least a feed conduit associated with a circumferential collector arranged around a wall of the reactor, which cooperates with a plurality of apertures or nozzles suitable to convey the current of gas inside the reactor.

17. The device as in claim 1, wherein between the first divergent upper zone and the second convergent lower zone there is a substantially cylindrical separation zone.

18. The device as in claim 1, wherein the means to introduce the load comprise tubes having outlets located to directly downwardly discharge into a diverging section of the reduction zone.

19. The device as in claim 18, wherein the means to discharge the exhaust fumes is located at an upper portion of the reactor higher than the outlets of the means to introduce the load.

* * * * *